United States Patent [19]

Crabtree

[11] Patent Number: 4,947,831

[45] Date of Patent: Aug. 14, 1990

[54] CPM LEG EXERCISING MACHINE

[76] Inventor: Ronald A. Crabtree, 40 Stairhaven Road, Allerton, Liverpool, L19 7NN, United Kingdom

[21] Appl. No.: 205,823

[22] Filed: Jun. 13, 1988

[51] Int. Cl.[5] ..... A61H 1/02

[52] U.S. Cl. ..... 128/25 R; 272/96

[58] Field of Search ..... 128/25 R, 25 B, 26, 128/70, 71, 74; 272/73, 96, 70, 71

[56] References Cited

U.S. PATENT DOCUMENTS

| | | | |
|---|---|---|---|
| 964,898 | 7/1910 | Budingen | 128/25 R |
| 2,227,526 | 1/1941 | Wilson | 128/25 R |
| 2,681,650 | 6/1954 | Goss | 272/70 |
| 3,039,456 | 6/1962 | Luce | 128/25 R |
| 3,301,553 | 1/1967 | Brakeman | 272/132 X |
| 4,558,692 | 12/1985 | Greiner | 128/25 R |
| 4,665,899 | 5/1987 | Farris et al. | 128/25 R X |

FOREIGN PATENT DOCUMENTS

| | | | |
|---|---|---|---|
| 75131 | 3/1983 | Fed. Rep. of Germany | 128/25 R |

*Primary Examiner*—Richard J. Apley
*Assistant Examiner*—H. N. Flaxman
*Attorney, Agent, or Firm*—Wood, Herron & Evans

[57] ABSTRACT

A leg exercising machine comprises a frame, a thigh support pivoted to the frame, a calf support pivoted to the thigh support, a foot support extending transversely to the calf support and pivoted thereto and a rotor carried by the frame. The foot support is pivoted to the rotor on an axis spaced from the axis rotation of the rotor and from the axis of pivoting of the foot support to the calf support. The axes of pivoting of the foot support and the calf support and parallel to each other and to the axis of rotation of the rotor.

9 Claims, 8 Drawing Sheets

CPM LEG EXERCISING MACHINE

FIELD OF THE INVENTION

This invention is concerned with an exercising machine.

It is an object of the invention to provide an exercising machine which can provide joint movement to the ankle and knee of a leg of a patient following injury or operation.

SUMMARY OF THE INVENTION

According to the invention, an exercising machine comprises a frame, a thigh support pivoted to the frame, a calf support pivoted to the thigh support, a foot support extending transversely to the calf support and pivoted thereto, a rotor carried by the frame, and means for driving said rotor, the foot support being pivoted to the rotor on an axis spaced from the axis of rotation of the rotor and from the axis of pivoting of the foot support to the calf support, and the axes of pivoting of said supports being parallel to each other and to the axis of rotation of the rotor.

Preferably, means are provided for adjusting the distance between the axis of pivoting of the foot support to the rotor and the rotor axis. Additionally or alternatively, means may be provided for adjusting the position of the rotor axis in the frame on an arc about the axis of pivoting of the thigh support to the calf support.

The effective length(s) of the thigh support and/or calf support between pivot axes may be adjustable to allow for leg length variations.

The rotor may suitably comprise a wheel while the driving means may be an electric motor.

The exercising machine preferably has means for limiting movement of said supports. For example, a stop may be provided on the frame to limit movement of the thigh support. That stop is preferably close to the pivotal attachment of the thigh support to the frame. The stop is preferably of metal covered with a layer of rubber or like material.

An additional or alternative movement limiting means may be provided between the foot support and the calf support, each being provided with stops that abut at the limit of desired movement.

For users of the exercising machine who may have a foot or ankle problem that does not permit their foot to rest flatly on the foot support, it is preferable that the foot support has a hinged section above the pivotal axis of the support, whereby the angle of the hinged section may be adjusted to suit the foot of the user.

The exercising machine of the invention may be used in a variety of situations the most common of which will probably be for a patient lying on a bed. For that purpose particularly, it will be advantageous for the frame of the exercising machine to have means for clamping same to a bed frame or other fixed support.

It may also be advantageous to provide a height adjustable platform, as part of a trolley, to which the exercising machine may be attached so that the machine can be maneuvered into a position suitable for a patient in more or less any situation, particularly one seated in a chair.

As well as being used for exercising one leg at a time, the exercising machine of the invention may be provided with a complementary set of supports and a rotor connected for pivotal movement to the opposite side of the drive means, so that a patient may exercise both legs at the same time. Thus, when the drive means is an electric motor, it may be provided with a suitable gear box and double output shaft for driving the rotors.

BRIEF DESCRIPTION OF THE DRAWINGS

The invention will now be further described, by way of example only, with reference to the accompanying schematic drawings, in which:

FIG. 12 is a side view of yet a further embodiment of the invention;

FIG. 13 is a plan view of the embodiment of FIG. 12; and

FIG. 14 is an end view of the embodiment of FIG. 12.

DESCRIPTION OF THE PREFERRED EMBODIMENTS

Figure 1:
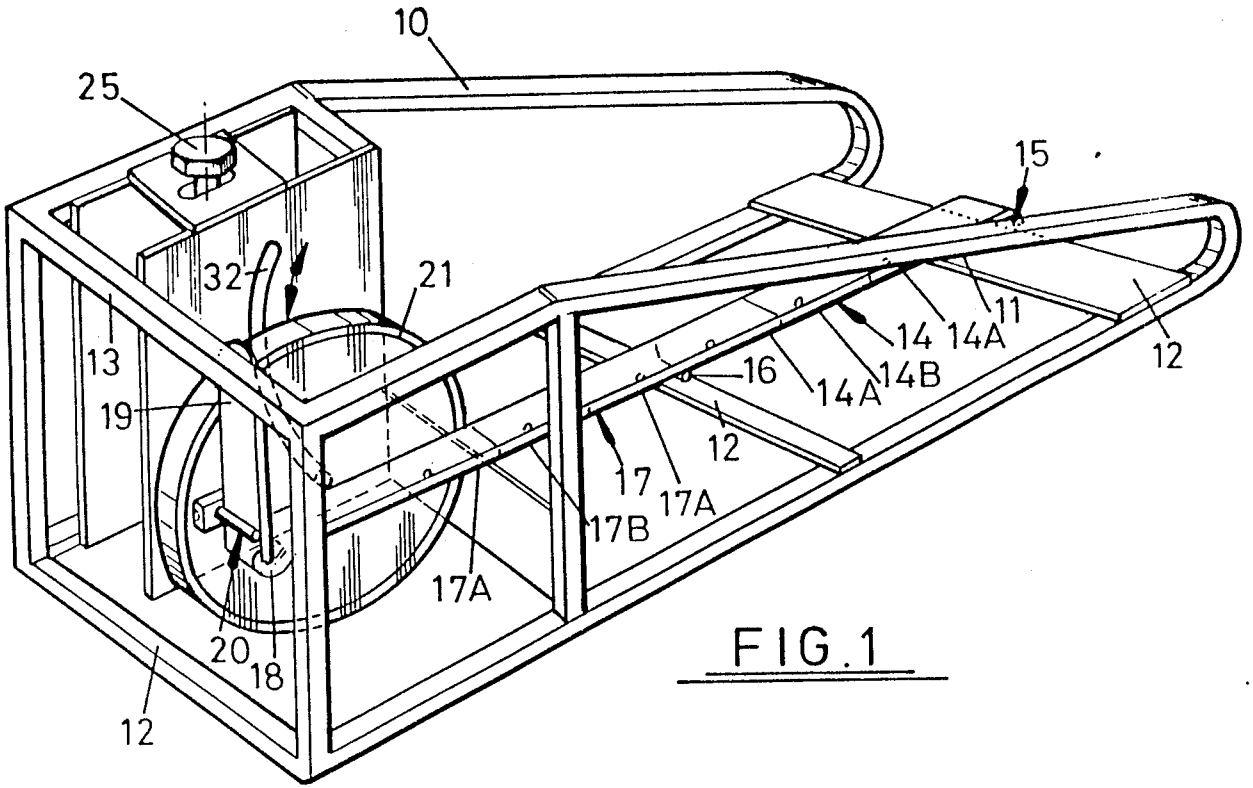
FIG. 1 is a perspective view of the frame of the machine, with supports and rotor installed.
Figure 3:
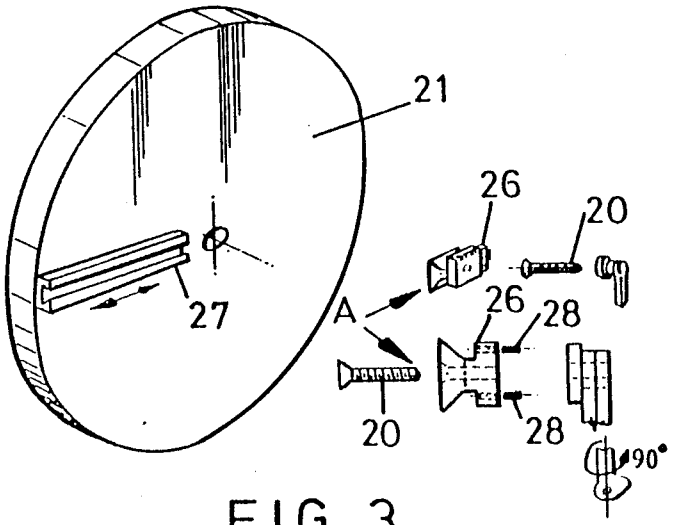
FIG. 3 is a perspective view of the rotor and associated parts.
Figure 2:
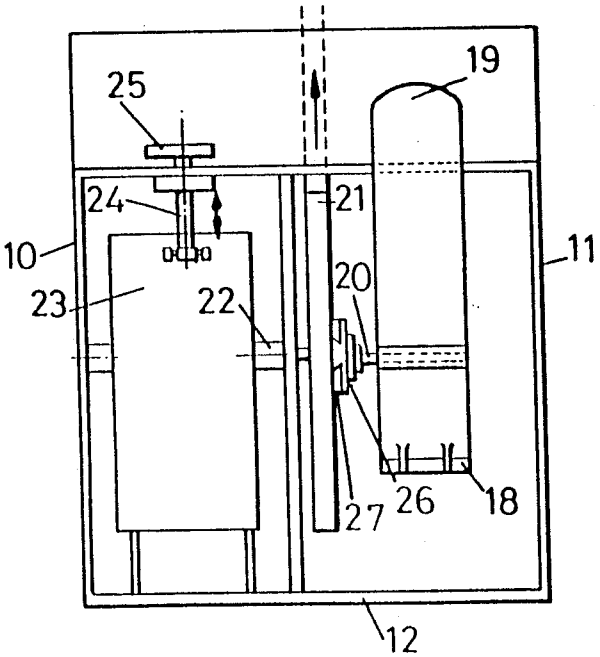
FIG. 2 is an end view from the left of FIG. 1.

The exercising machine shown in FIGS. 1 to 8 of the drawings has a generally horizontally extending frame comprising parallel side members 10, 11 connected by lower cross-members 12 and an upper cross-member 13 disposed at one end of the frame to provide a space between the side members for receiving a leg of a recumbent patient. A thigh support 14, of rectangular cross section is pivoted at one end by a pivot 15 to a cross-member 12 at the opposite end of the frame to the cross-member 13. The other end of the thigh support 14 is pivoted by a pivot 16 to one end of a calf support 17 also of rectangular cross-section which is pivoted at its other end by a pivot 18 to an upwardly-extending foot support 19. To cater for patients having different thigh and calf lengths, the supports 14 and 17 are made adjustable in length. Thus, the support 14 includes portions 14A which are telescopically received in a sleeve portion 14B, and suitable locking means are provided to lock the portions 14B in a set position in the sleeve 14B. These locking means can conveniently take the form of an integral spring loaded pin 30 (FIG. 8) which is manually releasable and which automatically registers in preselected holes in the support to lock the support. The support 17 has similar portions 17A, 17B and can have a similar locking arrangement. To allow for variation in lengths of the supports 14, 17, the pivot 15 is carried by a longitudinal bracket 31 (FIG. 8) which provides longitudinal adjustment of the pivot 15, the pivot 15 will be locked on the bracket 31 by suitable means, for example, by locking means similar to that described above for the support 14. Therefore, thigh length (and also calf length) adjustment is catered for by support adjustment and to some degree by the "take-up" bracket 31.

The foot support is pivoted by a pivot 20 at a position spaced from the pivot 18 to a wheel 21 supported by the frame, the axis of pivot 20 being spaced from the rotational axis of the wheel.

The axis of rotation of the wheel and the various axes of pivoting are parallel to each other. The wheel is driven through shaft 22 by an electric motor 23 with suitable reduction gearing, speed control means and time controlled switching means mounted in the frame. Means 24 manually operable by a knob 25 are provided for adjusting upwards and downwards the position of the motor 23 and therefore the wheel 21 in the frame, the shaft 22 being guided in an arcuate slot 32 having its centre of curvature on the axis of the pivot 16.

The arc/rotor adjustment thereby provided extends the range of the knee deflection while allowing the maximum leg length extension to be adjusted to give a starting angle of deflection (see FIG. 7) of zero.

The pivot 20 is carried by a sliding member 26 located in and slidably adjustable along a guide member 27 extending radially away from the wheel axis, the members 26 and 27 being of dovetail joint configuration. Thus, the radial distance of the pivot 20 from the wheel axis can be adjusted. The sliding member 26 can be locked in the desired position by screws 28 engaging in holes in the guide member 27. This provides a radius adjustment (see FIGS. 6A, 6B) which constrains the selected range thus giving a finer degree of range selection. Either the arc/rotor adjustment or the radius adjustment may be used to afford adjustment independently or inter-actively, whichever is found to be most suitable. The mechanism has linkage freedom to allow for automatic (arbitrary) ankle deflection but it could be possible to include specific means for controlled ankle movements.

Figure 4:
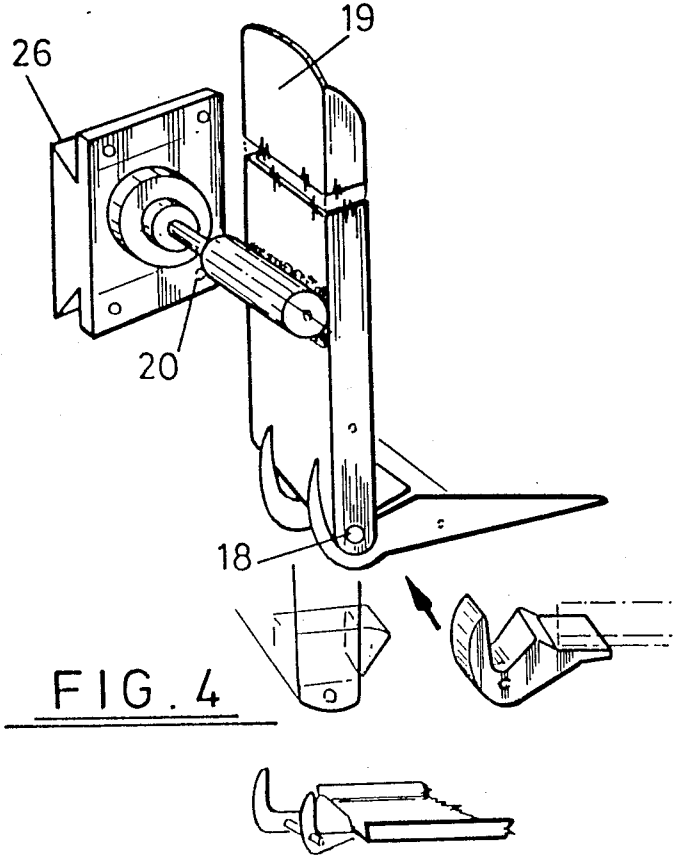
FIG. 4 is a perspective view of the foot, calf and thigh supports and pivotal connections.

FIG. 4 shows details of suitable pivotal connections and removable padding for the supports.

Figure 5:
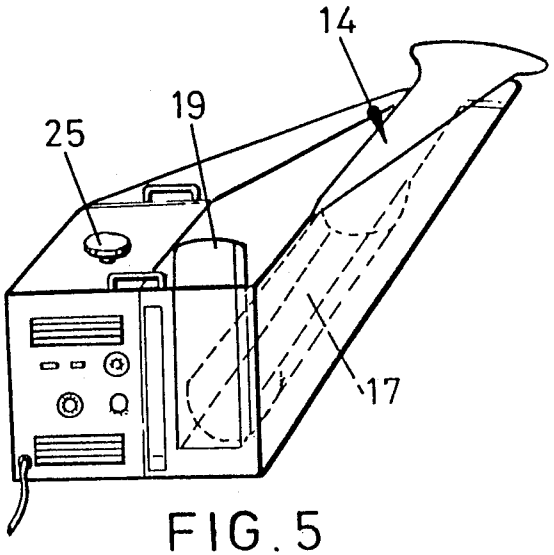
FIG. 5 is a perspective view from one end of the machine in condition ready for use.

FIG. 5 shows the machine fitted with its casing and controls and with removable ventilated padding for foot, calf, thigh and buttock fitted to the supports. The padding and panelling will serve to afford noise damping, comfort, hygiene and safety. The controls and adjustment means are suitably calibrated to enable ease of operation by the operator.

Figure 6A:
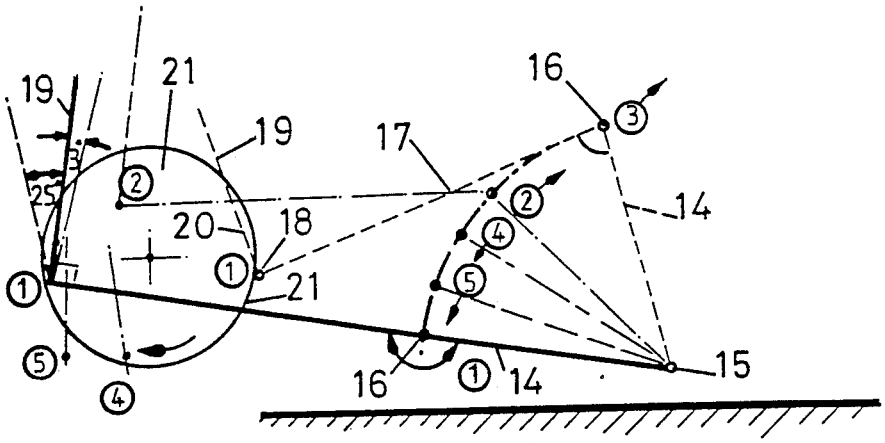
FIGS. 6A and 6B are diagrams illustrating the movement of the pivots and supports; and knee deflection for different radius settings of the ankle pivot.

FIG. 6A shows the position of the supports 14, 17 and 19 at different rotational positions of the wheel 21, the pivot 20 being at one set radial distance from the wheel axis (viz at maximum radius).

Figure 6B:
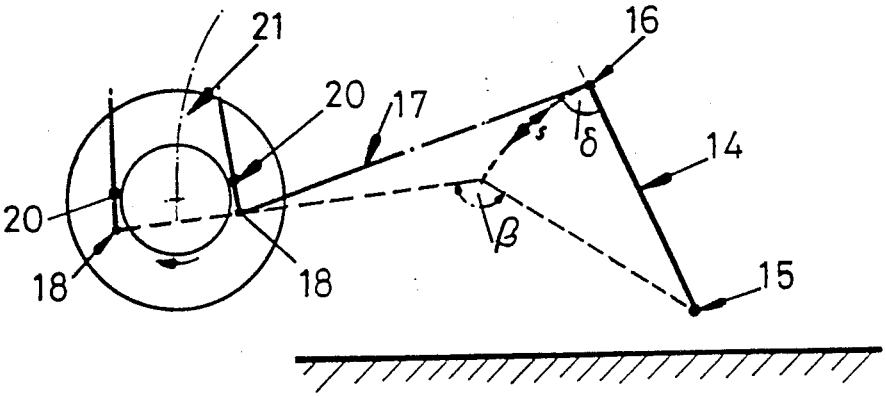

FIG. 6B is similar to FIG. 6A but in this case the pivot 20 is set at a reduced radius from the wheel axis. The different calf/thigh angles achieved by the FIGS. 6A and 6B arrangements will be readily apparent.

Figure 7:
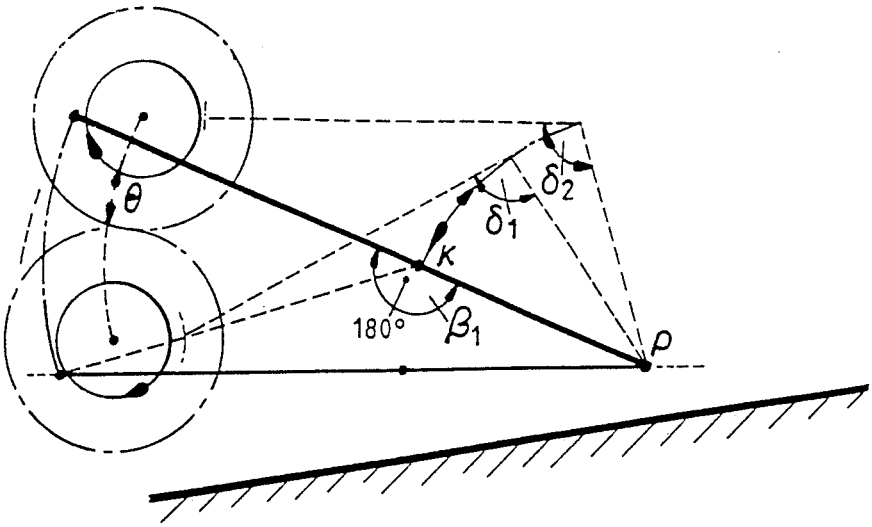
FIG. 7 is a diagram showing the effect of adjusting the position of the rotor axis in the frame.
Figure 8:
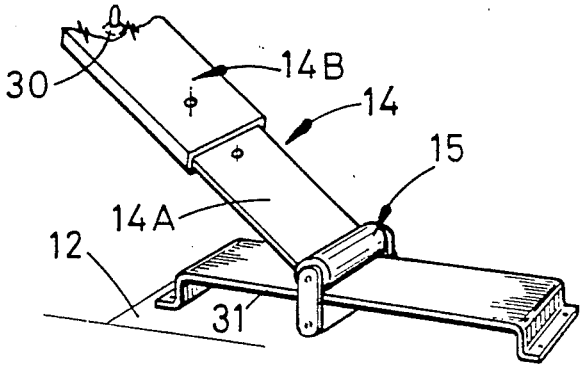
FIG. 8 is a schematic view in greater detail of the bracket adjustably carrying the thigh support pivot.

FIG. 7 shows the effect of moving the wheel axis up and down.

The machine is preferably constructed and calibrated to provide for:

1. Knee deflection range of 0–120 degrees with sub-range divisions.
2. Ankle deflection range from 20 degrees of dorsiflexion to 60 degrees of plantar flexion.
3. Leg lengths +100 mm.

Figure 9:
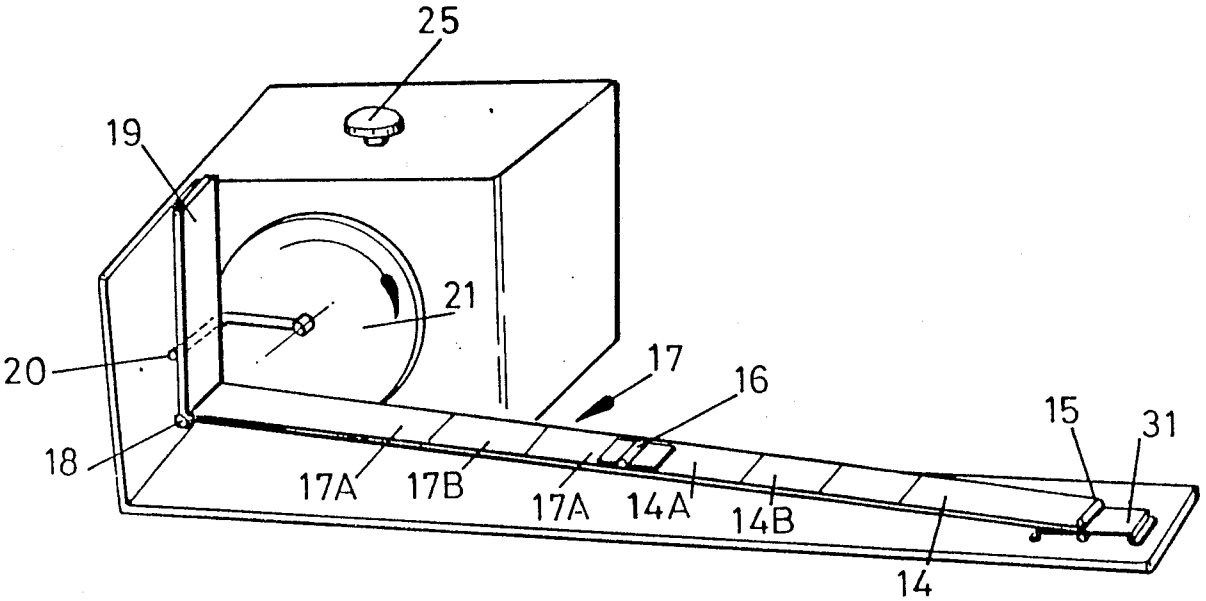
FIG. 9 shows an isometric view of another embodiment of the invention.

FIG. 9 shows a further embodiment where the machine frame is built up from plate construction.

Figure 10:
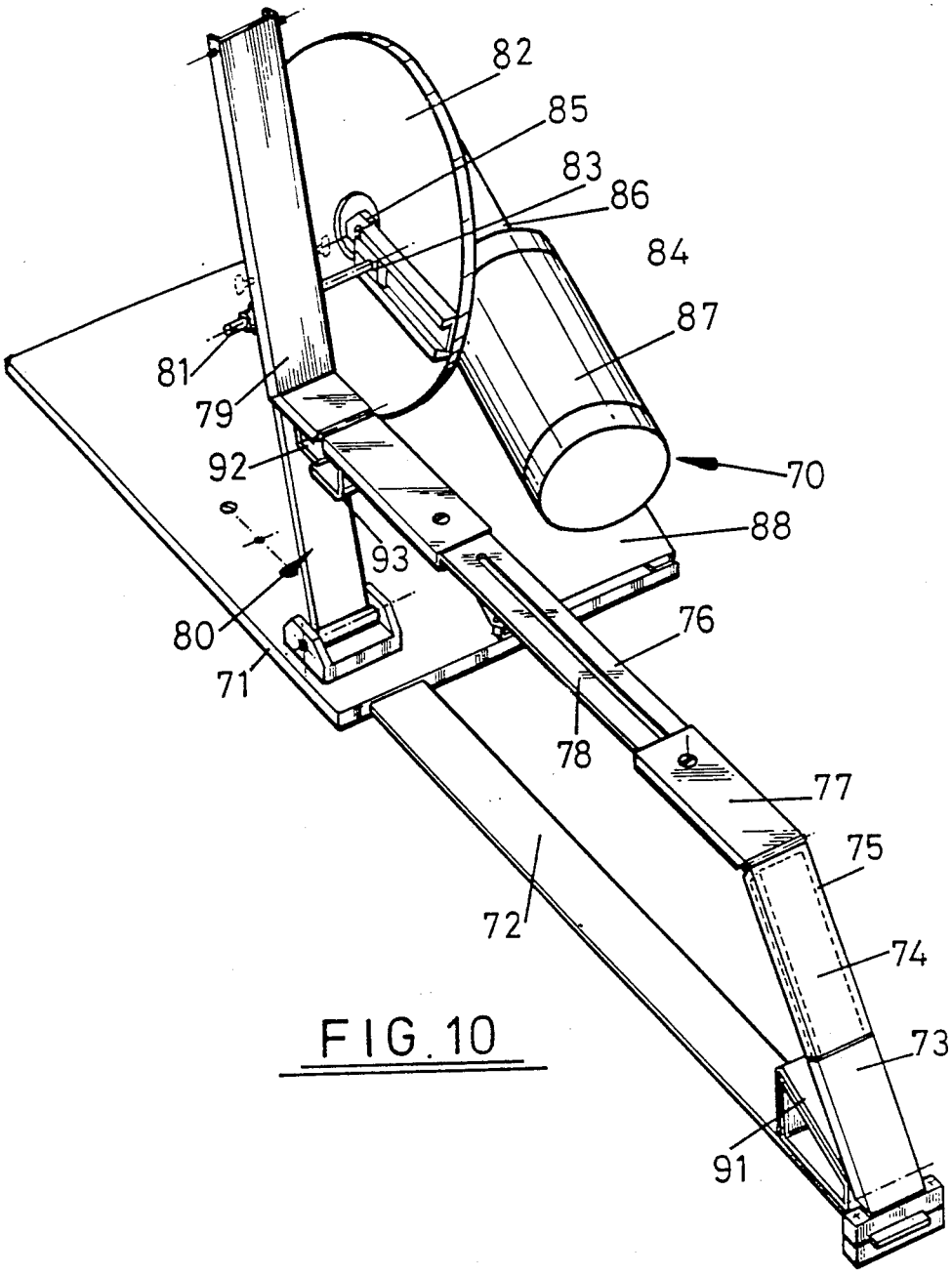
FIG. 10 is an isometric view of yet another embodiment of the invention.
Figure 11:
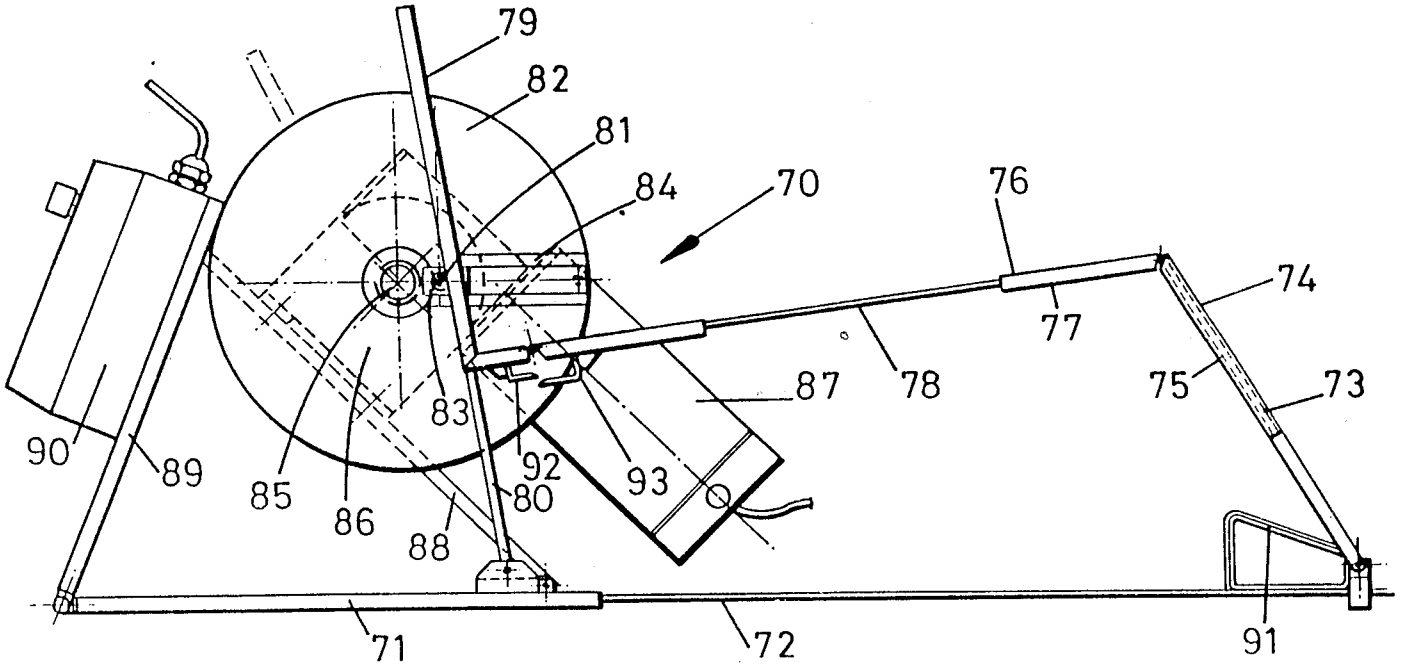
FIG. 11 is a side view of the embodiment of FIG. 10.

Turning to FIGS. 10 and 11 of the accompanying drawings, a leg exercising machine 70 comprises a generally square base frame 71 with an arm 72 slidably extending therefrom for adjustment of its length. The remote end of the arm 72 has pivotally connected thereto a thigh support 73 that is extendible in length by having a sleeve 74 slidably adjustable along guide member 75. The thigh support 73 is pivotally connected to a calf support 76 which is also length adjustable by having a sleeve member 77 slidably along guide member 78. Pivotally connected to the calf support is an L-shaped foot support 79 which is also pivotally connected to the base frame by an extension 80 of its longest side.

To the longest side of the foot support is attached to one end of a rotatable spindle 81 that is connected at its other end to a rotating disc 82. The connection to the rotating disc comprises a member 83 attached to the spindle and slidably mounted in a radial channel 84 on the disc 82. The disc 82 is mounted for rotation on a shaft 85 of a gear box 86 driven by an electric motor 87. The gear box and motor are mounted on a support member 88 pivotally attached to the base frame. The base frame 71 also has pivotally attached thereto a support member 89 for a controller 90 for the motor and also for support location of the member 88.

A movement limiting stop 91 of metal covered with rubber is provided between the thigh support 73 and the arm 72 and abutting stops 92 and 93 are also provided on the foot and calf supports respectively.

The various pivotal connections and length adjustments are to enable the exerciser to be arranged to accommodate any size of leg to be exercised and to adjust the degree of movement of the various parts of the leg according to the treatment required, as described above for other embodiments of the invention.

In other embodiments of the invention (not shown) a leg exercising machine has a base and attached to the base towards one side thereof is a mounting for an electric motor and gearbox. The electric motor may be adapted for main power operation. The electric motor has an axle that passes through a drive dog having a slot therealong. The position of the axle in the slot is adjusted by means of a screw threaded nut on the end of the axle. The slot also has secured therethrough by a nut, a spindle that is attached to a foot rest. The foot rest is slidably mounted on a tube that is slidable on a column. The column is hingedly connected to the base. The position of the tube on the column is fixable by means of screw threaded nuts which tighten the tube onto the column. The inclination of the foot rest to the column is adjustable by means of a pivotable link between the foot rest and the column, the angle of the link being fixable by a nut. From the foot rest extends a pair of parallel telescopic members between which depend U-shaped hangers for leg support. The pair of parallel telescopic members is pivotally attached to the sides of the foot rest and at their other end each to a further telescopic member that is pivotably attached to a slidable member on the base. The pair of parallel telescopic members and a further telescopic member as pivotally attached to the slidable member on the base are length adjustable and the parallel telescopic member is slidably adjusted to compensate for length adjustment of all telescopic members. Padding will be provided on the foot rest and leg supports and between members to provide thigh support.

In operation of the device just described and not shown, the length adjustable members and angle adjustable parts are first altered to suit the size of the patient's legs and the exercise required. The motor is then switched on, which rotates the dog drive. That causes reciprocal movement of the column and corresponding movement of the foot rest. The movement of the foot rest will cause both ankle and knee movement of the patients leg, the extent of movement of either being adjustable, as desired.

Exercising machines of the invention may be made of comparitively light weight so as to be readily portable. They have the advantage of providing a combined reciprocating and rotary motion which ensures natural translation to angular displacement at knee and ankle joints.

I claim:

1. An exercising machine comprising a frame, a thigh support pivoted to the frame, a calf support extending transversely to the calf support and pivoted thereto, a rotor carried by the frame, and means for driving said rotor, the foot support pivotally attached to the rotor, the pivotal axis of the foot support being spaced from the axis of rotation of the rotor and from the axis of pivoting of the foot support to the calf support, and the axes of pivoting of said thigh, calf and foot supports being parallel to each other and to the axis of rotation of the rotor such that upon driving of said rotor the knee and ankle joints are subjected to angular displacement.

2. An exercising machine as claimed in claim 1 having means for adjusting the distance between the axis of pivoting of the foot support to the rotor and the rotor axis.

3. An exercising machine as claimed in claim 1 for having means for adjusting the position of the rotor axis in the frame on an arc about the axis of pivoting of the thigh support to the calf support.

4. An exercising machine as claimed in claim 1, wherein the effective length(s) of at least one of the thigh support and calf support between pivot axes being adjustable to allow for leg variations.

5. An exercising machine as claimed in claim 1, wherein the rotor comprises a wheel.

6. An exercising machine as claimed in claim 1, wherein the driving means is an electric motor.

7. An exercising machine as claimed in claim 1 having means for limiting movement of said supports.

8. An exercising machine as claimed in claim 7, wherein said means for limiting movement comprises a stop on the frame for the thigh support.

9. An exercising machine as claimed in claim 7, wherein said means for limiting movement comprises stops on the foot rest and calf support.

* * * * *